United States Patent [19]

Barnard

[11] 4,256,187

[45] Mar. 17, 1981

[54] IMPACT TOOL WITH HYDRAULIC COCKING MECHANISM

[75] Inventor: Louis H. Barnard, Pasadena, Tex.

[73] Assignee: Hughes Tool Company, Houston, Tex.

[21] Appl. No.: 965,202

[22] Filed: Nov. 30, 1978

[51] Int. Cl.[3] ..... B25D 9/08; B25D 9/18; F01L 17/00

[52] U.S. Cl. ..... 173/119; 173/134; 91/276

[58] Field of Search ..... 173/119, 134, DIG. 4, 173/112, 116, 118, 128, 135, 138; 91/25, 165, 276, 189 R, 337, 341

[56] References Cited

U.S. PATENT DOCUMENTS

| | | | |
|---|---|---|---|
| 3,687,008 | 8/1972 | Densmone | 91/165 X |
| 3,827,507 | 8/1974 | Lance | 173/134 X |
| 3,866,690 | 2/1975 | Lance et al. | 91/165 X |
| 4,005,637 | 2/1977 | Bouyoucos et al. | 91/276 |
| 4,011,795 | 3/1977 | Barthe et al. | 91/165 |
| 4,077,304 | 3/1978 | Bouyoucos | 91/276 |

*Primary Examiner*—Werner H. Schroeder
*Assistant Examiner*—Andrew M. Falik
*Attorney, Agent, or Firm*—Robert A. Felsman

[57] ABSTRACT

An impact tool for mining, demolition work and the like. An energy storing device such as a coil spring, when compressed, accelerates a hammer to deliver a blow to a working tool. The hydraulic cocking mechanism has a compression chamber and a bias chamber. A shaft extends through the compression chamber and into the bias chamber. The shaft has an annular stop attached to it and reciprocally carries a compression sleeve above the annular stop. A bias member extends into the bias chamber. Input hydraulic pressure urges the bias member to press the compression sleeve into seating contact with the annular stop to define a piston. Hydraulic input pressure acting at the same time below the piston urges the shaft upward to cock the spring. At the top of the stroke, ports and passages reduce the pressure difference above and below the piston to allow the spring to force the shaft down for impact. On the downstroke, the compression sleeve and annular stop separate. Ports urge the sleeve back into sealing contact with the annular stop after impact. A resilient member cooperating with the sleeve and annular stop reduce damage to the sealing surface.

16 Claims, 7 Drawing Figures

IMPACT TOOL WITH HYDRAULIC COCKING MECHANISM

BACKGROUND OF THE INVENTION

1. Field of the Invention

This invention relates in general to an impact device for delivering blows to a working tool, and in particular to an improved hydraulic cocking mechanism for an impact tool.

2. Description of the Prior Art

Many types of impact tools for mining and breaking up concrete and the like are known. These devices have essentially an energy storage means such as a coil spring or gas chamber, a hammer, and a working tool. The energy storage means when compressed, causes the hammer to accelerate to the working tool to deliver a blow.

Various mechanisms are used to automatically recock the hammer to repeat the cycle and to release the hammer for the blow. Some are mechanical, using a rotating cam and cam follower. Others are hydraulic. The hydraulic types usually have a piston attached to the hammer for urging it upward to compress the energy storage device. Some have external control valves to alternately supply fluid to the piston chamber to cycle the hammer. Others have internal valves for automatically cycling the fluid to the piston chamber.

Some of the internal valve types have a solid piston, such as shown in U.S. Pat. No. 2,559,478. However, this requires that the piston push the chamber fluid out an exhaust port on the downstoke. Appreciable drag may result. Others of the internal valve type avoid this by having a piston made up of two separate components. For example, in U.S. Pat. No. 3,687,008, the shaft has an annular stop fixed to it that is smaller in diameter than the compression chamber. On the upstroke, the annular stop contacts a sleeve, which combines with the annular stop to define a piston. At the top of the stroke, the annular stop and sleeve separate with the annular stop and shaft going to impact. Since the annular stop is smaller in diameter than the chamber, it does not have to push all of the fluid below it out an exhaust port on the downstroke. At the bottom of the stroke, the sleeve is reseated with the annular stop. On the upstroke, a resistance or bias has to be applied to the sleeve, otherwise pressure below it would push it off of its seat with the annular stop. Also, some pressure from above has to be applied after the downstroke begins in order to push the sleeve back into seating contact with the annular stop. The device of U.S. Pat. No. 3,687,008 accomplishes this by placing a port at the top of the compression chamber with a fairly large back pressure.

U.S. Pat. No. 3,866,690 avoids having to bias the sliding sleeve into contact with the shaft annular stop by placing the sleeve below the annular stop. On the upstroke, the sleeve pushes the annular stop upward. At the top of the stroke, the sleeve must be returned to starting position first, then the annular stop is forced to impact by the gas spring.

U.S. Pat. No. 3,792,738 avoids having to push the piston chamber fluid out on the downstroke by using a piston with a central passage through it. A cylindrical valve above it is biased into contact with the piston passage to seal the passage on the upstroke. At the top of the stroke, the valve and piston separate opening the passage. This reduces the hydraulic pressure below the piston to allow the spring to push it downward. On the downstroke, fluid in the piston chamber passes through the central passage. The valve is biased and returned by the same hydraulic input pressures that drive the piston upward. The valve's pressure area is smaller than the piston, however, to provide a net upward force for cocking.

While these proposals may be suitable, improvements to an internally-valved hydraulic cocking mechanism are desired. In particular, means to absorb sealing surface shock as the annular stop and sleeve reseat is desirable.

SUMMARY OF THE INVENTION

It is the general object of this invention to provide an improved impact tool.

It is the further object of this invention to provide an improved hydraulic cocking mechanism for an impact tool.

It is the further object of this invention to provide an improved hydraulic cocking mechanism for an impact tool with internal valves for automatic cycling.

In accordance with these objects, a hydraulic cocking mechanism for an impact tool is provided that includes a housing having compression and bias chambers. A shaft with a fixed annular stop is carried in the compression chamber. A compression sleeve is carried in the compresssion chamber. It is located above the annular stop and has a lower seat for contacting the annular stop to define a piston. A bias member is reciprocally carried in the bias chamber. The bias member extends to the compression sleeve to maintain it in contact with the annular stop on the upstroke. Input fluid pressure is applied both below the piston and to the bias chamber. The areas of the piston and bias member are selected to provide a net upward force. Ports allow the compression sleeve and annular stop to separate at the top of the stroke and to reseat after impact. The annular stop includes an annular member connected with the shaft and a metal ring secured to the annular member to buffer the shock on reseating.

DESCRIPTION OF THE PREFERRED EMBODIMENT

Figure 1:
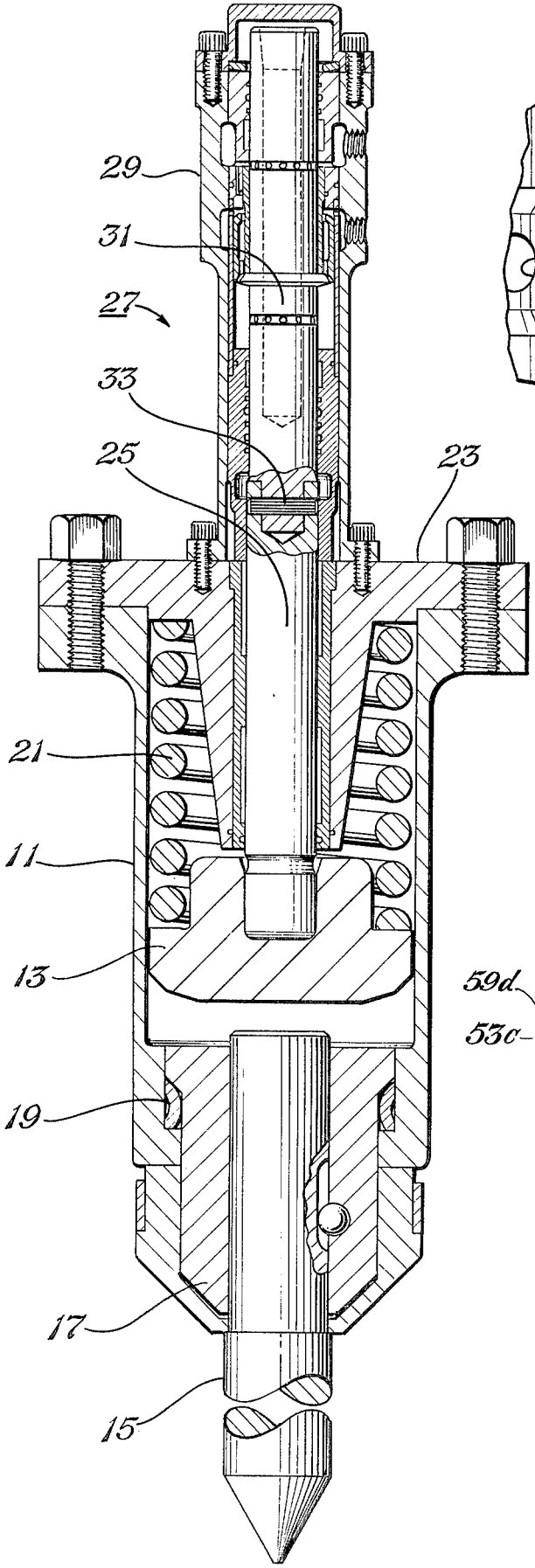
FIG. 1 is a vertical sectional view of an impact tool having a hydraulic cocking mechanism constructed in accordance with this invention.

Referring to FIG. 1, the impact tool includes an enclosure 11 within which a striker or hammer 13 is reciprocally carried. A working tool 15 is reciprocally carried within an anvil 17 at the bottom of the enclosure 11.

Anvil 17 is mounted in the enclosure by a buffer spring 19. Anvil 17 and buffer spring 19 absorb blows from the hammer if the working tool 15 is not in contact with the workpiece or if it breaks through the workpiece. A coil spring 21 is compressed between the top of the hammer 13 and the top 23 of enclosure 11. The shaft 25 is connected to the hammer 13 and extends upward through the top 23. Coil spring 21 serves as energy storage means to accelerate the hammer 13 to deliver a blow to the working tool 15 when the coil spring is compressed and the hammer released.

The hydraulic cocking means assembly 27 is bolted to the top 23 of enclosure 11. It includes a housing 29 mounted to the top of enclosure 11 and extending axially upward. A shaft 31 is reciprocally carried in housing 29. Shaft 31 which is connected to shaft 25 by pin 33, is urged downward by the energy storage means. The terms "downward" and "upward" are used herein with reference to the stroking movement of the hammer. The tool is operated in many orientations other than truly vertical.

In FIGS. 2 through 7, minor construction details have been eliminated to more clearly illustrate the hydraulic cocking mechanism. Referring to FIGS. 2 through 5, the housing 29 includes a bias or upper chamber 35 and a compression or lower chamber 37. Both chambers are cylindrical. The compression chamber 37 is larger in diameter than the bias chamber 35 and has an upper annular end or latching surface 37*a*. The bias chamber extends upwardly from the latching surface 37*a*.

The bias chamber 35 has a housing upper inlet port 39 and a housing lower inlet port 41. Ports 39 and 41 are spaced apart vertically and are joined by two vertical passages 43 (only one shown) in housing 29. Port 39 is connected to a pump (not shown) which supplies a direct flow of hydraulic fluid. The compression chamber 37 has an exhaust or outlet port 45. Port 45 leads without restriction or regulation to the return of the pump. Port 45 is located on the same vertical level as the latching surface 37*a*.

Figure 6:
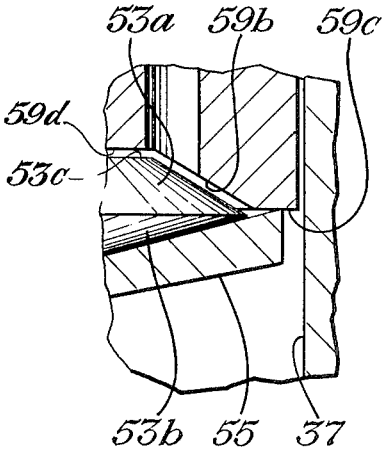
FIG. 6 is a partial enlarged view of the mechanism as shown in its position in FIG. 2.

Shaft 31 extends through the compression chamber 37 and bias chamber 35. Shaft 31 has an upper portion 31*a* and a lower portion 31*b*. Lower portion 31*b* is larger in diameter than the upper portion 31*a*. Shaft 31 has an internal, longitudinal or axial passage 47. A row of upper inlet ports 49 in shaft upper portion 31*a* extends from passage 47 into the bias chamber 35. A row of lower outlet ports 51 in shaft portion 31*b* extend from passage 47 into compression chamber 37. An annular band or member 53 is formed rigidly on the shaft at the intersection of the upper portion 31*a* with the lower portion 31*b*. Annular member 53 is located in the compression chamber 37 and is lesser in diameter than the compression chamber. As shown in FIG. 6, annular member 53 is solid and has an upper tapered surface 53*a* and a lower tapered surface 53*b*. The upper surface 53*a* increases in diameter as it proceeds downwardly to an intersection with a lower tapered surface 53*b*. The lower tapered surface decreases in diameter as it proceeds downwardly. The annular member 53 also has an upper annular surface 53*c* that is perpendicular to the axis of the tool.

A modified Belleville seal or ring 55 is secured to shaft 31*b* below annular member 53 by a retaining ring 57. Ring 55 is a frusto-conical, metal ring facing upwardly so that its upper surface is in flush, mating contact with the lower tapered surface 53*b*. The diameter of ring 55 is larger than the diameter of the annular member 53, but smaller than the diameter of the compression chamber 37. As shown in FIG. 6, the Belleville ring 55 is modified in that its thickness increases from the inner diameter outward, with the outer thickness slightly more than twice the thickness at the inner edge.

A compression or lower sleeve 59 is reciprocally carried in compression chamber 37. Compression sleeve 59 is cylindrical, with a periphery in sliding and sealing contact with the compression chamber wall. The compression sleeve 59 is axially movable with respect to shaft 31. Resilient bands or seals 61 are secured in the outer wall of sleeve 59. Compression sleeve 59 has an upper latching surface or shoulder 59*a* adapted to contact the latching surface 37*a* of the compression chamber. As shown in FIG. 6, compression sleeve 59 has a lower tapered surface 59*b*. A lower seat 59*c* joins the tapered surface 59*b* on its periphery. Lower seat 59*c* is perpendicular to the axis of the tool. The compression sleeve 59 has an inner annular surface 59*d* perpendicular to the axis of the tool. Lower seat 59*c* is adapted to contact the ring 55 before the surface 59*d* contacts the annular member surface 53*c*. Downward deflection of the ring occurs on impact, allowing surface 59*d* to bump or strike surfaces 53*c*. After initial impact, and on the upstroke, surfaces 53*c* and 59*d* separate, leaving a clearance. Tapered surfaces 59*b* and 53*a* do not contact each other at any time. The ring 55 serves not only as a seal but as resilient means to absorb some of the shock of contact when the compression sleeve 59 reseats. The deflection of ring 55 reduces damage to the sealing surfaces. Annular member 53 and ring 55 define an annular stop which combines with the compression sleeve 59 on the upstroke to form a piston.

Compression sleeve 59 is cup shaped, with a large diameter central opening 63. Twelve longitudinal or reseat passages 64 extend from the bottom of openings 63 to the lower tapered surface 59*b*, completing a passage from top to bottom of the compression sleeve.

A bias or upper sleeve 65 is reciprocally carried on upper shaft portion 31*a* in sliding and sealing contact. Bias sleeve 65 is cylindrical with an upper portion 65*a* in sliding and sealing contact with the bias chamber 35 wall. Bias sleeve 65 has a relieved or lower portion 65*b* that is of lesser diameter than upper portion 65*a*. This lower portion fits within the central opening 63 of the compression sleeve 59, bearing against the bottom of opening 63 adjacent reseat passages 64. The bias sleeve portion 65*b* is of lesser diameter than the central opening 63, communicating fluid above the compression sleeve with the reseat passages 64. Bias sleeve 65 moves in unison with compression sleeve 59 at all times, and could be constructed integrally with it if so desired. The upper edge 65*c* of the bias sleeve defines a pressure area to be acted on by hydraulic fluid pressure in bias chamber 35. This allows the bias sleeve to serve as bias means to urge the compression sleeve 59 into contact with the ring 55.

Figure 7:
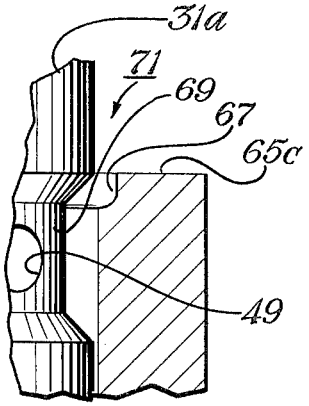
FIG. 7 is a partial enlarged view of the mechanism as shown in its position in either FIG. 2 or FIG. 3.

As shown in FIG. 7, a radiused recess 67 is formed on the inner upper edge of the bias sleeve 65. Shaft upper ports 49 are located in a reduced cylindrical portion 69. The length of bias sleeve 65 and the diameter of the portion 69 are selected to provide a clearance, or a seat orifice indicated as 71, to allow fluid to pass from the bias chamber into longitudinal passage 47. The pressure drop across the seat orifice 71 assists in urging sleeve 59 into contact with ring 55.

Figure 2:
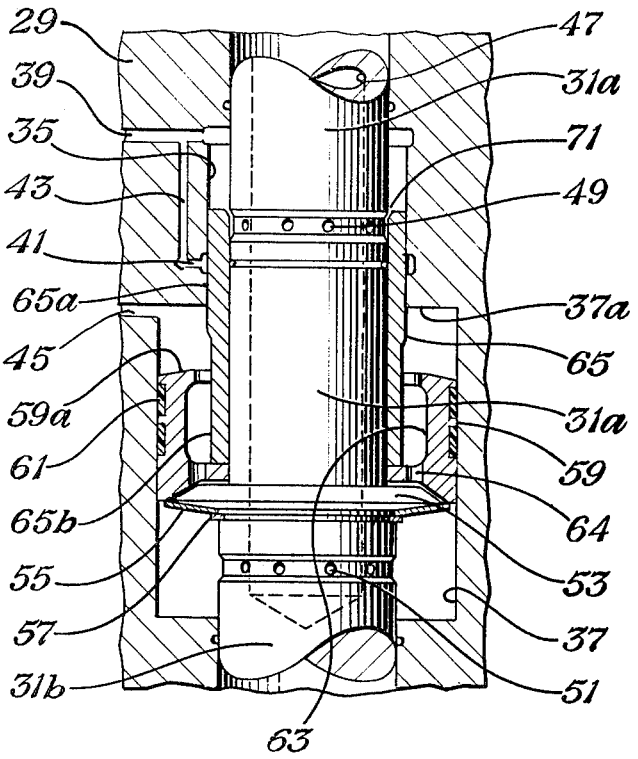
FIG. 2 is an enlarged vertical sectional view of the hydraulic cocking mechanism of FIG. 1, as shown in the position beginning immediately prior to the upstroke.

In brief summary of the operation, FIG. 2 shows the components at the moment the compression sleeve 59 contacts the Belleville ring 55 after impact. Hydraulic pressure at port 39 acts on upper edge 65*c* of the bias sleeve, urging the compression sleeve 59 into seating contact with the ring 55. Once seated, the combinationn of the ring 55 and compression sleeve 59 defines a piston in compression chamber 37. At the same time, fluid pressure from port 39 forces fluid through orifice 71 and out shaft lower ports 51 into compression chamber 37. Due to the difference in pressure areas of the bias sleeve upper edge 65*c* and the piston, the net force is upward, compressing power spring 21.

Figure 3:
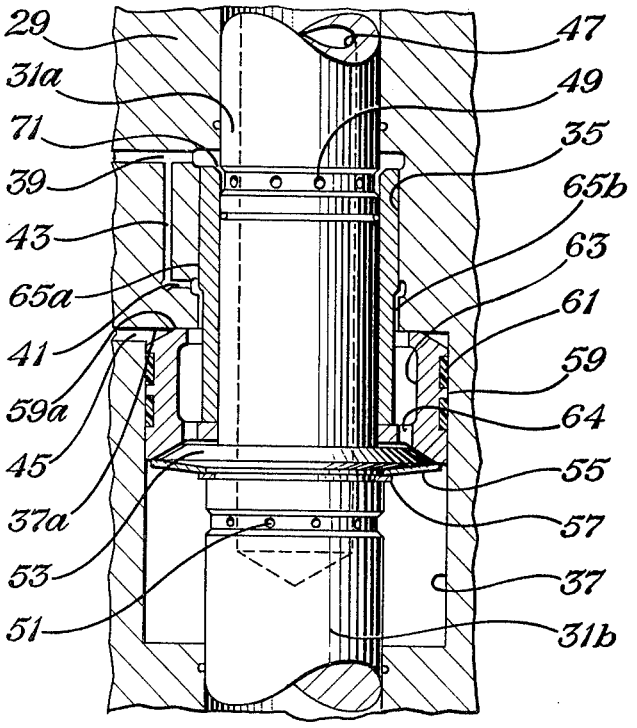
FIG. 3 is a view similar to FIG. 2, with the mechanism shown at the top stroke position.

At the top of the strke, as shown in FIG. 3, the compression sleeve 59 contacts the upper annular end or latch surface 37*a* of the compression chamber and closes the exhaust port 45. At this time, the relieved area 65*b* of the bias sleeve opens housing lower port 41 to the compression chamber above the piston. This reduces the difference in pressure above and below the piston, allowing the power spring 21 to push the hammer 13 to impact. Fluid in the compression chamber passes around the periphery of ring 55 as the shaft moves downward.

Figure 4:
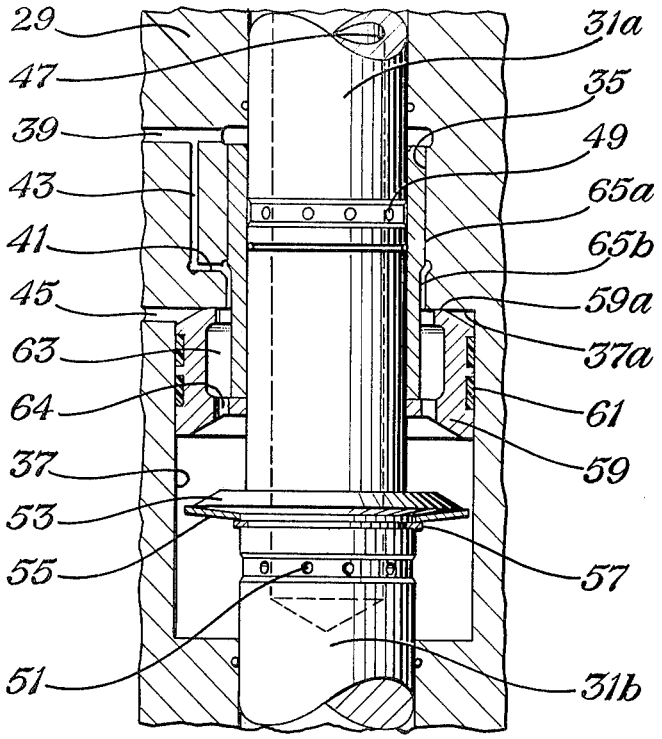
FIG. 4 is a view similar to FIG. 2, with the mechanism shown in the downstroke.
Figure 5:
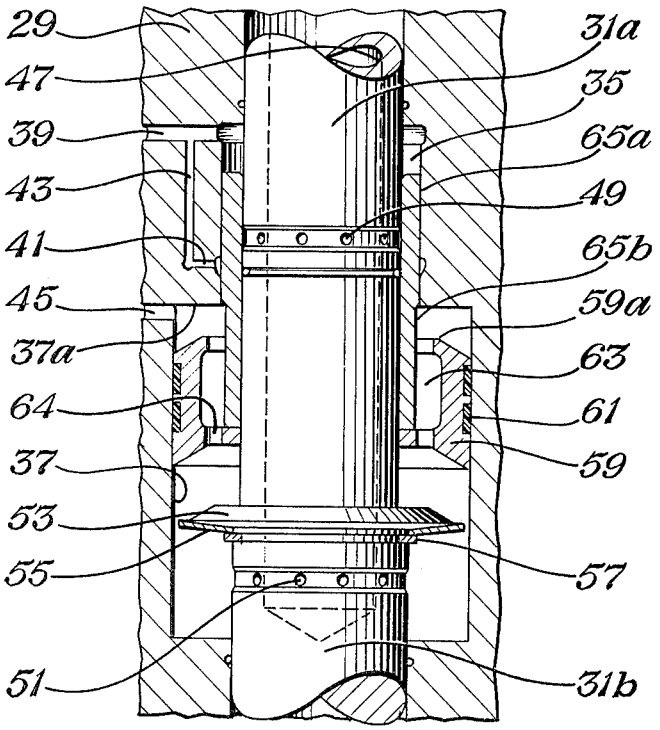
FIG. 5 is a view similar to FIG. 2, with the mechanism shown in a position after impact but before the compression sleeve has completed its downstroke.

The compression sleeve 59 remains momentarily latched to the latch surface 37*a*, after the shaft 31 starts downward as shown in FIG. 4. However, downward movement of the shaft 31 with different diameters tends to create a suction in chamber 37, causing the compression sleeve 59 to break loose before hanmer impact and move downward. This closes lower housing port 41, as shown in FIG. 5. Then, pressure at upper housing port 39 urges the bias sleeve 65 downward, causing the compression sleeve 59 to sealingly contact the ring 55 after hammer impact. At the time of sealing, the upper edge 65*c* of the bias sleeve exposes the upper shaft ports 49 to fluid pressure through orifice 71. This causes the cycle to repeat, these cycles occurring approximately ten per second.

In order to determine the various parameters to achieve the cycling, the steps of the cycle will be considered in more detail, assuming that:

$D_1$ = diameter of lower shaft portion 31*b*

$D_2$ = outer diameter of ring 55

$D_3$ = outer diameter of compression sleeve 59

$D_4$ = diameter of upper shaft porion 31*a*

$D_5$ = outer diameter of bias sleeve upper portion 65*a*

$D_6$ = "average" or "mean" diameter of the latching surface 59*a*

$P_{in}$ = hydraulic fluid pressure at port 39

$P_{lift}$ = hydraulic fluid pressure below the annular member 53, when seated with compression sleeve 59

$P_{latch}$ = pressure in central opening 63

F = power spring load at the top of the stroke $P_{in}$ = input flow at port 39

$Q_{separation}$ = flow through port 41 at the top of stroke $Q_{reseat}$ = flow through passages 64 in compression sleeve 59 while it moves downward $A_{reseat}$ = area of passages 64

Initially, the various diameters, pressure and flow rates are selected so that to start the cocking from a dead stop, the input fluid $Q_{in}$ will force bias sleeve 65 and compression sleeve 59 to seat on the ring 55. The size of the seat orifice 71 is selected to cause a pressure drop so that $P_{in}$ is greater than $P_{lift}$. These pressures and the pressure areas they act on keep the compression sleeve 59 seated on the ring 55 during cocking. As pressure $P_{lift}$ builds up with input fluid passing through shaft passage 47 and out the lower ports 51, the downward force on the bias sleeve 65 is greater than the upward force caused by $P_{lift}$ acting on the pressure area defined by the compression chamber diameter less the ring 55 diameter, i.e.:

$$P_{lift} < P_{in}$$

$$(D_3^2 - D_2^2) > (D_5^2 - D_4^2)$$

The closing of the compression sleeve 59 on ring 55 defines a piston in compression chamber 37 and starts the cocking stroke. The lower end now has a larger pressure or hydraulic area than the upper end, and the shaft 31 and sleeves 59, 65 move upward as follows:

$$P_{lift}(D_3^2 - D_1^2) > P_{in}(D_5^2 - D_4^2)$$

The power spring 21 is compressed until the compression sleeve latch surface 59*a* strikes the compression chamber latch surface 37*a* as shown in FIG. 3. A metal to metal face seal is formed between the latch surfaces. The momentum in the moving components causes deflection of ring 55 upon contact of compression sleeve 59 with latch surface 37*a*. The pressure $P_{latch}$, acting on the latch surface 59*a* builds up due to part of the input flow $Q_{separation}$. The deflection of ring 55 adds to the pressure $P_{latch}$. As the pressure $P_{latch}$ increases, the hydraulic lifting power of the actuating mechanism diminishes to a point where it can no longer support the power spring load, i.e.:

$$P_{lift}\,\pi/4\,(D_2^2 - D_1^2) - P_{latch}\,\pi/4\,(D_2^2\ 31\ D_4^2) < F$$

The power spring drives the shaft and hammer to impact as shown in FIGS. 4 and 5. The impact stroke of the hammer 13 is slightly impeded by a drag force created by fluid flowing around the ring 55. Keeping the area $D_3 - D_2$ as large as possible minimizes this source of blow energy loss.

The compression sleeve 59 remains latched to the latch surface 37*a*, as shown in FIG. 4, for a short period of time after separation because:

$$(P_{in} - P_{latch})(D_5^2 - D_4^2) < P_{latch}(D_3^2 - D_6^2)$$

As the shaft lower portion 31*b* moves out of the compression chamber 37, the volume it occupied at the top of the stroke cannot be completely filled since the upper portion 31*a* is of lesser diameter. Since the exhaust port 45 is closed, a vacuum will be drawn in the chamber 37 unless additional fluid is supplied to fill the void being created. Fluid is being added to the chamber through relieved portion 65*b*, however this flow, $Q_{separation}$, is selected to be insufficient to fill the void being created by selecting the sizes of vertical passages 43. The flow into chamber 37 from passages 43 is selected as follows:

$$Q_{separation} < C(D_1^2 - D_4^2)\,V,$$

where C is a constant, and V shaft impact velocity.

This vacuum delatching provides a point at which $P_{latch}$ can no longer keep the compression sleeve 59 latched before impact. The compression sleeve moves downward, as shown in FIG. 5. The lower housing inlet port 41 is closed by the bias sleeve 65 and the input flow $Q_{in}$ drives the sleeves 59 and 65 to seat on ring 55. The vacuum delatching serves as means to move the bias sleeve downward after the shaft has commenced its downstroke to close the lower housing inlet port.

The reseat passages 64 in compression sleeve 59 form a passage through which fluid below the compression sleeve must pass for the lower seat 59*c* to reseat. This flow, $Q_{reseat}$, is determined by:

$$Q_{reseat} = Q_{in} \frac{(D_3^2 - D_4^2)}{(D_5^2 - D_4^2)}$$

$P_{lift}$, prior to starting another cycle, should be raised to 200—600 psi. This reduces the shock of supplying high pressure input fluid to an empty chamber 37 when the upper shaft ports 49 are open to port 39. This is accomplished by adjusting the size of the passages 64, i.e.:

$(Q_{reseat}/24\ A_{reseat})^2$
should be in the 200—600 psi range

Upon recontact of compression sleeve 59 with ring 55, the ring 55 will initially deflect. The diameter of ring 55 is selected so that ring 55 will not contact the wall of compression chamber 37 under maximum deflection.

In summary, the spacing of the shaft ports, the housing ports, the bias sleeve, and the passages through the compression sleeve, serve as means for supplying hydraulic fluid pressure to the bias and compression chamber to move the shaft upward, then reducing the difference between the pressures above and below the piston to allow the energy storage means to accelerate the piston downward, for separating the sleeve from the annular stop during the downstroke, and for reseating the sleeve on the annular stop after impact for recocking.

One impact tool constructed in accordance with this invention uses a spring that requires a force of 7,000 pounds to compress it at the top of the stroke. The tool delivers 250–600 blows per minute. The flow, $Q_{in}$, is 12 to 28 gallons per minute for 21–22 blows per gallon. The input pressure, $P_{in}$, averages 1500 to 1600 pounds per square inch. The following dimensions are used:

$D_1$ =2.250 inches
$D_2$ =3.521 inches
$D_3$ =3.750 inches
$D_4$ =2.000 inches
$D_5$ =2.500 inches
$D_6$ =2.687 inches
Passages 43 are 0.045 to 0.055 inches in diameter
Passages 64 are 3/16 inches in diameter The clearance on the upstroke between annular member surface 53*c* and compression sleeve surface 59*d* is in the range from 0.015 inch to 0.040 inch. The ring 55 is preferably beryllium copper of thickness 0.033 inch at the inner diameter and 0.078 inch at the outer diameter. It should be apparent that an invention having significant advantages have been provided. The hydraulic cocking mechanism provides stroking for high energy impact tools. It performs cocking and releasing of the hammer automatically, without external valves, controls, or internal springs other than the energy storage means. The separate sleeve and annular stop define a piston on the upstroke that separates for impact, thus the piston does not have to push fluid out an exhaust port on the downstroke. The sleeve is located above the annular stop, and does not have to be returned to its original position prior to allowing the shaft to move to impact. By using input fluid to bias the sleeve into contact with the shaft annular stop, mechanical springs or restricted exhaust ports are not required. The exhaust valve is closed on impact avoiding surges of fluid out the exhaust port. The Belleville ring reduces the sealing surface shock of the compression sleeve and annular stop colliding. The flexibility of the ring allows relative movement of the compression sleeve and the annular stop during reseating, and also at the top of the stroke.

While the invention has been shown in only one of its forms, it should be apparent to those skilled in the art that it is not so limited but is susceptible to various changes and modifications without departing from the spirit thereof. For example, energy storage means such as a gas spring could be used rather than a coil spring.

I claim:

1. In an impact tool of the type having a hammer, a working tool, and energy storage means adapted when compressed to accelerate the hammer to deliver a blow to the working tool whe the hammer is released, an improved hydraulic cocking means for compressing the energy storage means and releasing the hammer, comprising:

a housing having bias and compression chambers;

a shaft connected to the hammer, extending into the compression chamber, and being urged downward by the energy storage means;

an annular stop rigidly connected to the shaft, located in the compression chamber and having a pressure area acted against by pressure in the compression chamber;

a compression sleeve in the compression chamber above the annular stop and having a pressure area acted against by pressure in the compression chamber, the sleeve being axially movable with respect to the shaft and having a periphery in sliding contact with the compression chamber, the compression sleeve having a lower seat adapted to contact the annular stop to define a piston with a pressure area equal to the sum of the pressure areas of the sleeve and the annular stop for urging the shaft upward;

a bias member extending from the sleeve into the bias chamber and being acted on by pressure in the bias chamber to bias the sleeve into contact with the annular stop while the shaft moves upward, the bias member having a pressure area acted against by pressure in the bias chamber, the pressure area of the bias member being less than the pressure area of the piston, but more than the pressure area of the sleeve; and means for supplying substantially the same hydraulic fluid pressure to the bias chamber and to the compression chamber below the piston and providing a substantially lower hydraulic fluid pressure above the piston to move the shaft upward, then at the top of the stroke for reducing the difference between the pressures above and below the piston and for separating the sleeve from the annular stop to allow the shaft to be moved downward by the energy storage means for impact with the hammer, and for reseating the sleeve on the annular stop after impact for recocking.

2. An impact tool, comprising:

an enclosure;

a hammer reciprocally carried in the enclosure;

working tool carried below the hammer for receiving blows from the hammer;

energy storage means in the enclosure adapted when compressed to accelerate the hammer to deliver a blow to the working tool;

a housing extending from the enclosure;

bias and compression chambers in the housing, the compression chamber being larger in diameter and below the bias chamber;

a shaft connected to the hammer, extending into the compression chamber, and being urged downward by the energy storage means;

an annular stop rigidly connected to the shaft, located in the compression chamber, having a pressure area acted against by pressure in the compression chamber, and being of lesser diameter than the compression chamber;

a compression sleeve slidingly carried in the compression chamber above the annular stop and having a pressure area acted against by pressure in the compression chamber, the compression sleeve being axially movable with respect to the shaft and having an outer wall in sliding contact with the compression chamber, the compression sleeve having a lower seat adapted to contact the annular stop to define a piston with a pressure area equal to the sum of the pressure areas of the annular stop and the compression sleeve for urging the shaft upward;

a bias sleeve slidingly carried by the shaft and extending from the compression sleeve into the bias chamber, the bias sleeve being axially movable with respect to the shaft, a portion of the periphery of the bias sleeve being in sliding contact with the bias chamber; the bias sleeve having a pressure area acted upon by pressure in the bias chamber that is greater than the pressure area of the compression sleeve to bias the compression sleeve into contact with the annular stop, the pressure area of the bias sleeve being sufficiently less than the pressure area of the piston to provide upward movement of the shaft during cocking; and means for supplying hydraulic fluid to the bias chamber and to the compression chamber at substantially the same pressure and for exhausting hydraulic fluid above the piston to move the shaft upward, then for reducing the difference between the pressures above and below the piston at full stroke and separating the compression sleeve from the annular stop, to allow the energy storage means to accelerate the hammer downward, and then for reseating the compression sleeve on the annular stop after impact for recocking.

3. In an impact tool of the type having a hammer, a working tool, and energy storage means adapted when compressed to accelerate the hammer to deliver a blow to the working tool when the hammer is released, an improved hydraulic cocking means for compressing the energy storage means and releasing the hammer, comprising:

a housing having bias and compression chambers;

a shaft connected to the hammer, extending into the compression chamber, and being urged downward by the energy storage means;

an annular stop rigidly connected to the shaft and located in the compression chamber;

a compression sleeve in the compression chamber above the annular stop, the sleeve being axially movable with respect to the shaft and having a periphery in sliding contact with the compression chamber, the compression sleeve having a lower seat adapted to contact the annular stop to define a piston for urging the shaft upward;

a bias member extending from the sleeve into the bias chamber and being acted on by pressure in the bias chamber to bias the sleeve into seating contact with the annular stop while the shaft moves upward;

means for supplying hydraulic fluid to the bias and compression chambers to move the shaft upward, then at the top of the stroke, reducing the difference between the pressures above and below the piston to separate the sleeve from the annular stop and to allow the shaft to be moved downward by the energy storage means for impact of the hammer, and for reseating the sleeve on the annular stop after impact for recocking; and resilient means cooperating with the annular stop and compression sleeve in addition to the hydraulic fluid in the compression chamber to absorb sealing surface shock when the compression sleeve is reseated on the annular stop after impact.

4. In an impact tool of the type having a hammer, a working tool, and energy storage means adapted when compressed to accelerate the hammer to deliver a blow to the working tool when the hammer is released, an improved hydraulic cocking means for compressing the energy storage means and releasing the hammer comprising;

a housing having bias and compression chambers;

a shaft connected to the hammer, extending into the compression chamber, and being urged downward by the energy storage means;

an annular member rigidly connected to the shaft and located in the compression chamber;

a metal ring rigidly secured to the shaft below and in contact with the annular member, the ring being thin and resilient and having a periphery extending beyond the annular member, the ring having a diameter less than the compression chamber;

a compression sleeve in the compression chamber above the annular member, the sleeve being axially movable with respect to the shaft and having a periphery in sliding contact with the compression chamber, the compression sleeve having a lower seat adapted to sealingly contact the ring to define a piston for urging the shaft upward;

a bias member extending from the sleeve into the bias chamber and being acted on by pressure in the bias chamber to bias the sleeve into seating contact with the annular member while the shaft moves upward; and means for supplying hydraulic fluid pressure to the bias and compression chambers to move the shaft upward, then at the top of the stroke reducing the difference between the pressures above and below the piston to separate the sleeve from the annular member and to allow the shaft to be moved downward by the energy storage means for impact of the hammer, and for reseating the sleeve on the annular member after impact for recocking.

5. In an impact tool of the type having a hammer, a working tool, and energy storage means adapted when compressed to accelerate the hammer to deliver a blow to the working tool when the hammer is released, an improved hydraulic cocking means for compressing the energy storage means and releasing the hammer, comprising:

a housing having bias and compression chambers, the compression chamber being larger in diameter and below the bias chamber;

a shaft connected to the hammer, extending into the compression chamber, and being urged downward by the energy storage means;

an annular member rigidly connected to the shaft, located in the compression chamber and being of lesser diameter than the compression chamber;

a metal ring rigidly secured to the shaft below and in contact with the annular member, the ring being frusto-conical, inwardly facing, thin and resilient, the ring having a greater diameter than the annular member but a lesser diameter than the compression chamber;

a compression sleeve slidingly carried in the compression chamber above the annular member, the compression sleeve being axially movable with respect to the shaft and having an outer wall in sliding contact with the compression chamber, the compression sleeve having a lower seat adapted to contact the portion of the ring extending beyond the annular member to define a piston, the lower seat of the compression sleeve being located so as to allow deflection of the ring prior to bumping the annular member;

a bias sleeve slidingly carried by the shaft and extending from the compression sleeve into the bias chamber, the bias sleeve being axially movable with respect to the shaft, a portion of the periphery of the bias sleeve being in sliding contact with the bias chamber; the bias sleeve having a pressure area acted upon by pressure in the bias chamber to bias the compression sleeve into contact with the ring, the pressure area of the bias sleeve being sufficiently less than the pressure area of the piston to provide upward movement of the shaft during cocking; and means for supplying a direct flow of hydraulic fluid to the bias and compression chambers to move the shaft upward, then for reducing the difference between the pressures above and below the piston at full stroke to separate the compression sleeve from the ring and to allow the energy storage means to accelerate the piston downward, and then for reseating the compression sleeve on the ring after impact for recocking.

6. In an impact tool of the type having a hammer, a working tool, and a coil spring to accelerate the hammer to deliver a blow to the working tool when compressed, an improved hydraulic cocking means for compressing the coil spring and releasing the hammer, comprising;

a housing having bias and compression chambers;

a shaft connected to the hammer, extending into the compression chamber, and being urged downward by the coil spring;

an annular member rigidly connected to the shaft and located in the compression chamber;

a metal ring rigidly secured to the shaft below and in contact with the annular member, the ring being frusto-conical, upwardly facing, thin and resilient, the ring having a larger diameter than the annular member but a lesser diameter than the compression chamber;

a compression sleeve carried in the compression chamber above the annular member, the compression sleeve being axially movable with respect to the shaft and having a periphery in sliding contact with the compression chamber, the compression sleeve having a lower seat adapted to sealingly contact the ring to define a piston for urging the shaft upward;

a bias member extending from the sleeve into the bias chamber and being acted upon by pressure in the bias chamber to bias the compression sleeve into sealing contact with the ring while the shaft moves upward; and means for supplying hydraulic fluid to the bias and compression chambers to move the shaft upward, for reducing the difference between the pressures above and below the piston at the top of the stroke to allow the spring to accelerate the shaft downward, for separating the compression sleeve from the ring during the downstroke, and for reseating the compression sleeve on the ring after impact for recocking.

7. In an impact tool of the type having a hammer, a working tool, and energy storage means adapted when compressed to accelerate the hammer to deliver a blow to the working tool, an improved hydraulic cocking means for compressing the energy storage means and releasing the hammer, comprising;

a housing having bias and compression chambers, the compression chamber being larger in diameter and below the bias chamber;

a shaft connected to the hammer, extending through the compression chamber and being urged downward by the energy storage means, the shaft having an internal longitudinal passage with upper ports being located in the bias chamber and lower ports being located in the compression chamber;

an annular stop rigidly connected to the shaft in the compression chamber between the upper and lower ports and having a pressure area acted against by pressure in the compression chamber;

a compression sleeve carried in the compression chamber above the annular stop and having a pressure area acted against by pressure in the compression chamber, the compression sleeve being axially movable with respect to the shaft and having an outer wall in sliding contact with the compression chamber, the compression sleeve having a lower seat adapted to contact the annular stop to define a piston with a pressure area equal to the sum of the pressure areas of the annular stop and the compression sleeve for urging the shaft upward;

a bias sleeve slidingly carried by the shaft and extending from the compression chamber into the bias chamber, the bias sleeve being axially movable with respect to the shaft and having a periphery in sliding contact with the bias chamber, the bias sleeve having a pressure area acted upon by the pressure in the bias chamber that is greater than the pressure area of the compression sleeve to bias the compression sleeve into contact with the annular stop, the pressure area of the bias sleeve being sufficiently less than the pressure area of the piston to provide upward movement of the shaft during cocking; and means for supplying a direct flow of hydraulic fluid to the bias chamber, thence to enter the shaft upper ports, exit the shaft lower ports and simultaneously apply pressure to the pressure area of the bias sleeve and to the pressure area of the piston to move the shaft upward, then for reducing the difference between the pressures above and below the piston at the top of the stroke to allow the energy storage means to accelerate the hammer downward, to separate the compression sleeve from the annular stop during the downstroke, then for reseating the compression sleeve on the annular stop after impact for recocking.

8. In an impact tool of the type having a hammer, a working tool, and energy storage means adapted when compressed to accelerate the hammer to deliver a blow to the working tool, and improved hydraulic cocking means for compressing the energy storage means and releasing the hammer, comprising:

a housing having bias and compression chambers, the compression chamber being larger in diameter and below the bias chamber;

a shaft connected to the hammer, extending through the compression chamber and being urged downward by the energy storage means, the shaft having an internal longitudinal passage with upper ports being located in the bias chamber and lower ports being located in the compression chamber;

an annular member rigidly connected to the shaft in the compression chamber between the upper and lower ports;

a metal ring rigidly secured to the shaft below and in contact with the annular member, the ring being thin and resilient and having a periphery extending byond the annular member, the ring having a diameter less than compression chamber;

a compression sleeve carried in the compression chamber above the annular member, the compression sleeve being axially movable with respect to the shaft and having an outer wall in sliding contact with the compression chamber, the compression sleeve having a lower seat adapted to contact the ring to define a piston with a pressure area for urging the shaft upward;

a bias sleeve slidingly carried by the shaft and extending from the compression chamber into the bias chamber, the bias sleeve being axially movable with respect to the shaft and having a periphery in sliding contact with the bias chamber, the bias sleeve having a pressure area acted upon by the pressure in the bias chamber to bias the compression sleeve into contact with the ring, the pressure area of the bias sleeve being sufficiently less than the pressure area of the piston to provide upward movement of the shaft during cocking; and means for supplying a direct flow of hydraulic fluid to the bias chamber, thence to enter the shaft upper ports, exit the shaft lower ports and simultaneously apply pressure to the pressure area of the bias sleeve and to the pressure area of the piston to move the shaft upward, then for reducing the difference between the pressures above and below the piston at the top of the stroke to allow the energy storage means to accelerate the shaft downward, to separate the compression sleeve from the ring during the downstroke, then for reseating the compression sleeve on the ring after impact for recocking.

9. In an impact tool of the type having a hammer, a working tool, and energy storage means adapted when compressed to accelerate the hammer to deliver a blow to the working tool when the hammer is released, an improved hydraulic cocking means for compressing the energy storage means and releasing the hammer comprising:

a housing having bias and compression chambers, the compression chamber being larger in diameter than the bias chamber and spaced below it;

a housing upper inlet port in the housing communicating with the bias chamber for receiving high pressure hydraulic fluid;

a housing lower inlet port in the housing communicating with the bias chamber and spaced below the housing inlet port for receiving high pressure hydraulic fluid;

and outlet port in the housing communicating with the compression chamber for returning hydraulic fluid;

a shaft connected to the hammer, extending through the compression chamber and into the bias chamber; the shaft being urged downward by the energy storage means;

a longitudinal internal passage located in the shaft;

a shaft inlet port in communication with the internal passage and located in the bias chamber;

a shaft outlet port in communication with the internal passage and located in the compression chamber;

an annular stop rigidly fixed to the shaft in the compression chamber between the shaft inlet and outlet ports;

a compression sleeve reciprocally carried by the shaft above the annular stop, the compression sleeve having an outer wall in sliding contact with the compression chamber and a lower seat adapted to contact the annular stop to define a piston with a pressure area for urging the shaft upward, the compression sleeve having a longitudinal passage therethrough;

a bias sleeve reciprocally and sealingly carried on the shaft and extending from the compression sleeve into the bias chamber, the bias sleeve being in sliding and sealing engagement with the bias chamber, the bias sleeve having an upper surface acted upon by hydraulic fluid from the housing upper inlet port to bias the compression sleeve into contact with the annular stop; the bias sleeve being positioned with respect to the shaft inlet port so as to expose the shaft inlet port to the bias chamber to admit fluid during the upstroke, but to close the shaft inlet port during downstroke; the bias sleeve having a lower relief that provides a passage from the lower housing inlet port to the compression chamber at the top of the stroke to reduce the difference between the pressures above and below the piston to allow the energy storage means to accelerate the hammer to impact; and means to move the bias sleeve downward after the shaft has commenced its downstroke to close the lower housing inlet port, allowing pressure in the bias chamber to urge the compression sleeve into contact with the annular stop to again begin upstroke.

10. In an impact tool of the type having a hammer, a working tool, and energy storage means adapted when compressed to accelerate the hammer to deliver a blow to the working tool when the hammer is released, an improved hydraulic cocking means for compressing the energy storage means and releasing the hammer, comprising:

a housing having a cylindrical compression chamber with an upper annular end and a cylindrical bias chamber extending upwardly from the upper annular end;

a housing upper inlet port in the housing communicating with the bias chamber for receiving high pressure hydraulic fluid;

a housing lower inlet port in the housing communicating with the bias chamber and spaced below the upper housing inlet port for receiving high pressure hydraulic fluid;

an outlet port in the housing adjacent to the upper annular end of the compression chamber for returning hydraulic fluid;

a shaft connected to the hammer and being urged downwardly by the energy storage means, the shaft having an upper portion and a lower portion of larger diameter than the upper portion;

a longitudinal internal passage located in the shaft;

a shaft inlet port in communication with the internal passage and located in the upper portion of the shaft;

a shaft outlet port in communication with the internal passage and located in the lower portion of the shaft;

an annular stop rigidly fixed to the shaft in the compression chamber between the shaft inlet and outlet ports and dividing the upper and lower portions of the shaft;

a compression sleeve reciprocally carried by the upper portion of the shaft of the annular member, the compression sleeve having an outer wall in sealing and sliding contact with the compression chamber and a lower seat adapted to contact the annular stop to define a piston with a pressure area for urging the shaft upward, the compression sleeve having a longitudinal passage therethrough; the compression sleeve having an upper annular surface adapted to contact the upper annular end of the compression chamber; the compression sleeve closing the housing outlet port while in contact with the upper annular end; the contact of the compression sleeve upper annular surface with the compression chamber upper annular end defining the top of the stroke;

a bias sleeve reciprocally and sealingly carried on the shaft and extending from the compression sleeve into the bias chamber where it engages the bias chamber in sliding and sealing contact, the bias sleeve having an upper surface acted upon by fluid from the housing upper inlet port to bias the compression sleeve into contact with the annular stop; the bias sleeve being positioned with respect to the shaft upper inlet port so as to expose the shaft upper inlet port to the bias chamber to admit fluid during the upstroke, but to close the shaft upper inlet port during downstroke; the bias sleeve having a lower cylindrical portion of diameter less than the bias chamber to communicate the housing lower port with the compression chamber at the top of the stroke for reducing the difference in the pressures above and below the piston to allow the energy storage means to accelerate the shaft downward and the hammer to impact;

the downward movement of the shaft tending to create a void in the compression chamber due to the lesser diameter of the upper portion of the shaft, the flow of fluid from the housing lower inlet port being selected to be insufficient to fill the void as it is being created, thereby creating a suction and drawing the compression sleeve downward; and resilient means cooperating with the annular stop and compression sleeve to absorb sealing surface shock when the compression sleeve is reseated on the annular stop after impact.

11. In an impact tool of the type having a hammer, a working tool, and energy storage means adapted when compressed to accelerate the hammer to deliver a blow to the working tool when the hammer is released, an improved hydraulic cocking means for compressing the energy storage means and releasing the hammer comprising:

a housing having a cylindrical compression chamber with an upper annular end and a cylindrical bias chamber extending upwardly from the upper annular end;

a housing upper inlet port in the housing communicating with the bias chamber for receiving high pressure hydraulic fluid;

a housing lower inlet port in the housing communicating with the bias chamber and spaced below the upper housing inlet port for receiving high pressure hydraulic fluid;

an outlet port in the housing adjacent the upper annular end of the compression chamber for returning hydraulic fluid;

a shaft connected to the hammer and being urged downwardly by the energy storage means, the shaft having an upper portion and a lower portion of larger diameter than the upper portion;

a longitudinal internal passage located in the shaft;

a shaft inlet port in communication with the internal passage and located in the upper portion of the shaft;

a shaft outlet port in communication with the internal passage and located in the lower portion of the shaft;

an annular member rigidly fixed to the shaft in the compression chamber between the shaft inlet and outlet ports and dividing the upper and lower portions of the shaft;

a frusto-conical metal ring rigidly secured to the shaft below and in contact with the annular member, the ring being thin and resilient and having a periphery extending beyond the annular member but of lesser diameter than the compression chamber;

a compression sleeve reciprocally carried by the upper portion of the shaft above the annular member, the compression sleeve having an outer wall in sealing and sliding contact with the compression chamber and a lower seat adapted to sealingly contact the ring to define a piston with a pressure area for urging the shaft upward, the compression sleeve having longitudinal passage extending therethrough; the compression sleeve having an upper annular surface adapted to contact the upper annular end of the compression chamber, the compression sleeve closing the housing outlet port while in contact with the upper annular end; the contact of the compression sleeve upper annular surface with the compression chamber upper annular end defining the top of the stroke; and a bias sleeve reciprocally and sealingly carried on the shaft and extending from the compression sleeve into the bias chamber where it engages the bias chamber in sliding and sealing contact, the bias sleeve having an upper surface acted upon by fluid from the housing upper inlet port to bias the compression sleeve into sealing contact with the ring; the bias sleeve being positioned with respect to the shaft upper inlet port so as to expose the shaft upper inlet port to the bias chamber to admit fluid during the upstroke, but to close the shaft upper inlet port during downstroke; the bias sleeve having a lower cylindrical portion of diameter less than the bias chamber to communicate the housing lower port with the compression chamber at the top of the stroke for reducing the difference in the pressures above and below the piston to allow the energy storage means to accelerate the shaft downward and the hammer to impact;

the downward movement of the shaft tending to create a void in the compression chamber due to the lesser diameter of the upper portion of the shaft, the flow of fluid from the housing lower port being selected to be insufficient to fill the void as it is being created, thereby drawing the compression sleeve downward;

12. In an impact tool of the type having a hammer, a working tool, and energy storage means adapted when compressed to accelerate the hammer to deliver a blow to the working tool, an improved hydraulic cocking means for compressing the energy storage means and releasing the hammer, comprising:

a housing having a compression chamber, a shaft connected to the hammer, extending into the compression chamber, and being urged downward by the energy storage means;

an annular stop rigidly connected to the shaft and located in the compression chamber;

a compression sleeve carried in the compression chamber, the compression sleeve having a periphery in sliding contact with the compression chamber and being axially movable with respect to the shaft, the compression sleeve adapted to contact the annular stop to define a piston for urging the shaft upward;

means for supplying hydraulic fluid below the piston to urge it upward, for reducing the difference betweenn the pressure above and below the piston at the top of the stroke to allow the energy storage means to accelerate the hammer downward, for separating the sleeve from the annular stop during the downstroke, and for reseating the sleeve with the annular stop after impact for recocking; and resilient means cooperating with the annular stop and compression sleeve in addition to the hydraulic fluid in the compression chamber to absorb sealing surface shock when the compression sleeve is reseated with the annular stop after impact.

13. An impact tool, comprising:

an enclosure;

a hammer recipocally carried in the enclosure;

a working tool carried below the hammer for receiving blows from the hammer;

energy storage means in the enclosure adapted when compressed to accelerate the hammer to deliver a blow to the working tool;

a housing mounted to the top of the enclosure;

a compression chamber located in the housing;

a shaft connected to the hammer, extending into the compression chamber, and being urged downward by the energy storage means;

an annular member rigidly connected to the shaft and located in the compression chamber;

a metal ring rigidly secured to the shaft below and in contact with the annular member, the ring being thin and resilient and having a periphery extending beyond the annular member but of lesser diameter than the compression chamber;

a compression sleeve carried by the shaft in the compression chamber, the compression sleeve having a periphery in sliding contact with the compression chamber and being axially movable on the shaft, the compression sleeve having a lower seat adapted to sealingly contact the ring to define a piston for urging the shaft upward; and means for supplying hydraulic fluid pressure below the piston to urge it upward, for reducing the difference between the pressures above and below the piston at the top of the stroke to allow the energy storage means to accelerate the hammer downward, for separating the sleeve from the ring during the downstroke, and for reseating the sleeve on the ring after impact for recocking.

14. In an impact tool of the type having a hammer, a working tool, energy storage means adapted when compressed to accelerate the hammer to deliver a blow to the working tool, and hydraulic cocking means for cocking the hammer that includes a compression chamber, a shaft in the compression chamber with an annular stop connected to it, a compression sleeve reciprocally carried in the chamber and means for causing the compression sleeve to contact the annular stop to define a piston on the upstroke, to separate from the annular stop at the top of the stroke, and to reseat after impact, the annular stop comprising:

an annular member rigidly connected with the shaft; and a metal ring rigidly secured to the shaft in contact with the annular member, the ring being frustoconical, thin and reilient, the ring having a greater diameter than the annular member, but being lesser in diameter than the compression chamber, the compression sleeve having a surface adapted to contact the periphery of the ring prior to bumping the annular member at impact, allowing the ring to deflect to absorb sealing surface shock.

15. In an impact tool of the type having a hammer, a working tool, and energy storage means adapted when compressed to accelerate the hammer to deliver a blow to the working tool, an improved hydraulic cocking means for compressing the energy storage means and releasing the hammer, comprising:

a housing having a compression chamber;

a shaft connected to the hammer, extending into the compression chamber, and being urged by the energy storage means downward;

an annular stop rigidly connected to the shaft and located in the compression chamber;

a compression sleeve carried in the compression chamber above the annular stop, the compression sleeve being axially movable with respect to the shaft and having a periphery in sliding contact with the compression chamber, the compression sleeve having a lower seat adapted to contact the annular stop to define a piston for moving the shaft upward;

bias means for urging the compression sleeve into contact with the annular stop during the upstroke; and means for supplying hydralic fluid pressure below the piston to urge it upward, for reducing the difference between the pressure above and below the piston at the top of the stroke to allow the energy storage means to accelerate the hammer downward for separating the sleeve from the annular stop during the downstroke, and for reseating the sleeve on the annular stop after impact for recocking; and resilient means cooperating with the annular stop and compression sleeve in addition to the hydraulic fluid in the compression chamber to absorb sealing surface shock when the compression sleeve is reseated on the annular stop after impact.

16. In an impact tool of the type having a hammer, a working tool, and energy storage means adapted when compressed to accelerate the hammer to deliver a blow to the working tool, an improved hydrualic cocking means for compressing the energy storage means and releasing the hammer, comprising:

a housing having a compression chamber;

a shaft connected to the hammer, and being urged downward by the energy storage means, the shaft having an upper portion and a lower portion, both reciprocally extending through the compression chamber, the lower portion being of larger diameter than the upper portion;

an annular stop rigidly connected to the shaft;

a compression sleeve carried in the compression chamber above the annular stop, the compression sleeve being axially movable with respect to the shaft and having an outer wall in sliding contact with the compression chamber, the compression sleeve having a lower seat to contact the annular stop to define a piston, the compression sleeve having a longitudinal passage therethrough that is sealed by the annular stop on the upstroke, but allows the passage of fluid when separated from the annular stop;

an outlet port in the housing communicating the compression chamber with the return of a hydraulic fluid source; the outlet port being located so as to be closed by the compression sleeve at the top of the stroke;

bias means for urging the compression sleeve into contact with the annular stop on the upstroke;

means for supplying hydraulic fluid to the chamber below the piston to urge the shaft upward, for supplying hydraulic fluid to the chamber above the annular stop at the top of the stroke and stopping the flow below the piston to allow the energy storage means to move the shaft downward, the downward movement of the shaft tending to create a void in the chamber due to the lesser diameter of the upper portion of the shaft, the flow of fluid above the annular stop being selected to be insufficient to fill the void as it is being created, creating a suction to draw the compression sleeve downward.

* * * * *

UNITED STATES PATENT OFFICE

CERTIFICATE OF CORRECTION

Patent No. 4,256,187 Dated Mar. 17, 1981

Inventor(s) LOUIS H. BARNARD

It is certified that error appears in the above-identified patent and that said Letters Patent are hereby corrected as shown below:

At column 5, line 14, "strke" should be --stroke--;
At column 6, line 9, "$(D_3^2-D_2^2) > (D_5^2-D_4^2)$ should be --$(D_3^2-D_2^2) < (D_5^2-D_4^2)$--;
At column 6, line 33 "$P_{lift}\pi/4(D_2^2-D_1^2)-P_{latch}\pi/4$ $(D_2^2$ 31 $D_4^2) < F$" should be --$P_{lift}\pi/4(D_2^2-D_1^2)-P_{latch}$ $\pi/4$ $(D_2^2-D_4^2) < F$--;
At column 7, line 56, "have" should be --has--;
At column 8, line 18 "whe" should be --when--;
At column 8, line 67 --a-- should be inserted before "working";
At column 11, line 12 "inwardly" should be --upwardly--;
At column 13, line 11 "and" should be --an--;
At column 13, line 29 "byond" should be --beyond--;
At column 14, line 14, "and" should be --an--;
At column 17, line 42 "betweenn" should be --between--;
At column 17, line 43 "pressure" should be --pressures--;
At column 17, line 56 "recipocally" should be --reciprocally--;
At column 18, line 37 "reilient" should be --resilient--;
At column 19, line 4 a comma should be inserted after "downward".

Signed and Sealed this

*Sixteenth* Day of *February 1982*

[SEAL]

*Attest:*

GERALD J. MOSSINGHOFF

*Attesting Officer* *Commissioner of Patents and Trademarks*